US011408599B1

(12) United States Patent
Oross et al.

(10) Patent No.: US 11,408,599 B1
(45) Date of Patent: Aug. 9, 2022

(54) ARTICULATING LINEAR HIGH BAY LIGHT FIXTURE

(71) Applicant: RAB Lighting Inc., New York, NY (US)

(72) Inventors: Glen Oross, San Diego, CA (US); Nicholas Calaceto, Paramus, NJ (US); Peter On, Houston, TX (US); Timothy Milberger, Sacramento, CA (US)

(73) Assignee: RAB Lighting Inc., New York, NY (US)

( * ) Notice: Subject to any disclaimer, the term of this patent is extended or adjusted under 35 U.S.C. 154(b) by 0 days.

(21) Appl. No.: 17/466,428

(22) Filed: Sep. 3, 2021

(51) Int. Cl.

| | |
|---|---|
| ***F21V 21/30*** | (2006.01) |
| ***F21V 21/03*** | (2006.01) |
| ***F21V 23/00*** | (2015.01) |
| ***F21Y 105/16*** | (2016.01) |
| ***F21Y 115/10*** | (2016.01) |

(52) U.S. Cl.
CPC ..... *F21V 21/30* (2013.01); *F21V 21/03* (2013.01); *F21V 23/003* (2013.01); *F21Y 2105/16* (2016.08); *F21Y 2115/10* (2016.08)

(58) Field of Classification Search
CPC ..... F21V 21/30; F21V 21/03; F21V 21/003
USPC ..... 362/220
See application file for complete search history.

(56) References Cited

U.S. PATENT DOCUMENTS 6,517,222 B1 * 2/2003 Orlov ..... F21S 8/06 362/147
7,131,753 B1 * 11/2006 Edwards, Jr. ..... F21S 2/005 362/225
8,430,529 B2 * 4/2013 Christ ..... F21V 21/0925 362/183
9,316,384 B2 4/2016 Mumma et al.
9,617,133 B2 * 4/2017 Davis ..... F16M 11/10
9,732,951 B2 * 8/2017 Guercio ..... F21V 23/008
10,352,537 B2 * 7/2019 Li ..... F21S 6/005
(Continued)

FOREIGN PATENT DOCUMENTS

DE 202009003239 7/2009

OTHER PUBLICATIONS

Lumatek Adjust-a-Lite Hid Reflector Adjustable Wing to 600W product purchase page; retrieved from <https://www.ebay.co.uk/itm/Lumatek-Adjust-a-Lite-Hid-Reflector-Adjustable-Wing-To%20600W/143688691084? hash=item2174836d8c:g:rp4AAOSw8DZfPIJd> on Jan. 18, 2021.

(Continued)

*Primary Examiner* — Bryon T Gyllstrom
(74) *Attorney, Agent, or Firm* — Innovation Law Office; Dennis S. Schell

(57) ABSTRACT

A light fixture includes a central housing, a panel, a light source, and a tether. The central housing defines first and second side surfaces and a bottom surface, and the bottom surface defines a plane. The panel is pivotably coupled with the first side surface, and the light source is coupled with the panel. The tether is coupled at one end with the panel to pivotably suspend the panel, and the second end of the tether includes an attachment member. The attachment member is configured to selectively couple with any one of a plurality of anchor positions located on the central housing. The panel is therefore fixable between a plurality of angles relative to the plane as determined by the attachment member being coupled with a selected one of the plurality of anchor positions.

20 Claims, 7 Drawing Sheets

(56) References Cited

U.S. PATENT DOCUMENTS

| | | | | |
|---|---|---|---|---|
| 2003/0137835 | A1* | 7/2003 | Mier-Langner | F21V 27/00 362/648 |
| 2011/0133670 | A1 | 6/2011 | Lee et al. | |
| 2013/0271993 | A1* | 10/2013 | Jan | F21V 14/02 362/249.1 |
| 2014/0268755 | A1 | 9/2014 | Kotovsky et al. | |
| 2015/0009666 | A1* | 1/2015 | Keng | F21V 23/002 362/249.02 |
| 2018/0156427 | A1* | 6/2018 | Bailey | F21V 23/001 |

OTHER PUBLICATIONS

Adjust A Wings; New Generation CMH Hellion Single-Ended (SE) and Double-Ended (DE) Ceramic Metal Halide Illumination Kits; retrieve from <https://www.adjustawings.com/> on Jan. 18, 2021.

Adjust A Wing Enforcer-Medium Reflector purchase page on Amazon; Retrieved from <https://www.amazon.co.uk/Adjust-A-Wing-Enforcer-Medium-Reflector/dp/BOOYPH3G28> on Jan. 18, 2021.

Foldable LED Garage Light Deformable Ceiling Light Angle Adjustable, for Basement Garage Shop Ceiling Work Lighting purchase page; Retrieved from <https://www.walmart.com/ip/Led-Deformable-Garage-Light-6000Lm-120W-192LED-Barn-Utility-Shop-Adjustable-4-Wings-Basement-Working-lighting-Ceiling-Lighting-Work-Lights/689148866> on Jan. 18, 2021.

King Wing Double End 90x90cm Reflector purchase page; retrieved from <https://hydroponicxpress.com.au/shop/p-king-wing-double-end-90x90cm-reflector.html> on Jan. 18, 2021.

* cited by examiner

ARTICULATING LINEAR HIGH BAY LIGHT FIXTURE

FIELD

Embodiments of this disclosure relate generally to lighting fixtures (also known as luminaires) and lighting fixtures with changeable configurations, including lighting fixtures with configurations that may be changed for storage, shipping, or use.

BACKGROUND

Once lighting fixtures are manufactured, they are typically placed in containers such as cardboard boxes for storage or shipping. At least one problem realized by the inventors of the current disclosure is that the lighting fixtures can occupy a lot of space, requiring more packaging for storing the lighting fixtures and increasing the cost of shipping the lighting fixtures. The inventors noticed this was especially true for lighting fixtures that are relatively large when installed, such as troffer or high bay light fixtures that are frequently used in a business or industrial environment. Further, the inventors noticed that many troffer or high bay light fixtures are manufactured with fixed dimensions and lighting distributions, while certain installations would benefit from customizable fixture dimensions and lighting distributions. As such, the inventors realized that problems exist with the current lighting fixtures and that improvements in the ability to change the size and configurations of lighting fixtures, such as for storage, shipping, or installation, are needed.

Certain features of the present disclosure address these and other needs and provide other important advantages.

SUMMARY

Embodiments of the present disclosure provide improved apparatuses and methods for changing the dimensions and configurations of a lighting fixture, including a lighting fixture that can change its overall size, dimension, and lighting distribution. Various aspects of different embodiments of the present disclosure are expressed in the following paragraphs.

Embodiments of the present disclosure include a lighting fixture having articulating members that may be positioned in certain configurations for storage or shipping, reducing the size of the lighting fixture and the storage or shipping container, and may be positioned in certain configurations for customized installation and operation. A portion of the lighting fixture (for example, a top portion) is used to mount the lighting fixture to a building (for example, a ceiling in a room). The lighting fixture also includes one or more articulating members having lighting elements, such as light emitting diodes (LEDs), installed thereon for lighting an area of the room. The articulating members may be independently configurable to distribute light in one of many available directions or may be independently configurable to form a preferred overall light fixture dimension for storage or shipping. The embodiment illustrated by each of the figures described herein incorporates this type of articulating functionality into a high-bay lighting fixture, which is generally thought of as a lighting fixture than hangs below a high ceiling. In other non-illustrated embodiments, it should be understood that the features and functions of the described high-bay lighting fixture may also be incorporated into various other forms of light fixtures, such as troffers, which are generally thought of as lighting fixtures having an inverted trough-like feature serving as a support and as a reflector for a light source. Accordingly, description herein relating specifically to high-bay lighting fixtures is not intended to be limiting in any way.

In some embodiment as described herein, a light fixture can include a central housing, a first panel, a first light source, and a first tether. The central housing can define first and second side surfaces and a bottom surface, and the bottom surface can define a first plane. The first panel can have a first edge and a second edge, the first edge pivotably coupled with the first side surface, the second edge being opposite to the first edge. The first light source can be coupled with a first side of the first panel. The first tether can have a first end and a second end. The first end can be coupled with the first panel to pivotably suspend the first panel about the first edge. Additionally, the second end can include a first attachment member and the central housing can include a first plurality of anchor positions. In some embodiments, the first attachment member can be configured to selectively couple with any one of the first plurality of anchor positions, where the first panel can further be fixable between a first plurality of angles relative to the first plane as determined by the attachment member being coupled with a selected one of the first plurality of anchor positions.

Embodiments according to the light fixtures described herein can optionally include additional features. For example, the first panel can be fixable to a first angle relative to the first plane when the first attachment member is coupled with the selected one of the first plurality of anchor positions. Further, the first panel can be fixable to a second angle relative to the first plane when the first attachment member is coupled with a different anchor position of the first plurality of anchor positions, where the first and second angles are different.

In some embodiments, the light fixture can include a second panel having a first edge and a second edge and defining a second plane, where the first edge of the second panel can be pivotably coupled with the second side surface of the central housing. Additionally, the light fixture can include one or more of a second light source coupled with a first side of the second panel, and a second tether having a first end and a second end. More particularly, the first end of the second tether can be coupled with the second edge of the second panel, and the second end of the second tether can include a second attachment member. In this embodiment, the second attachment member can be configured to selectively couple with any one of a second plurality of anchor positions, where the second panel can therefore be fixable between a second plurality of angles relative to the second plane as determined by the attachment member being coupled with a selected one of the second plurality of anchor positions. In some embodiments, the first and second panels are independently fixable between the first and second plurality of angles.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
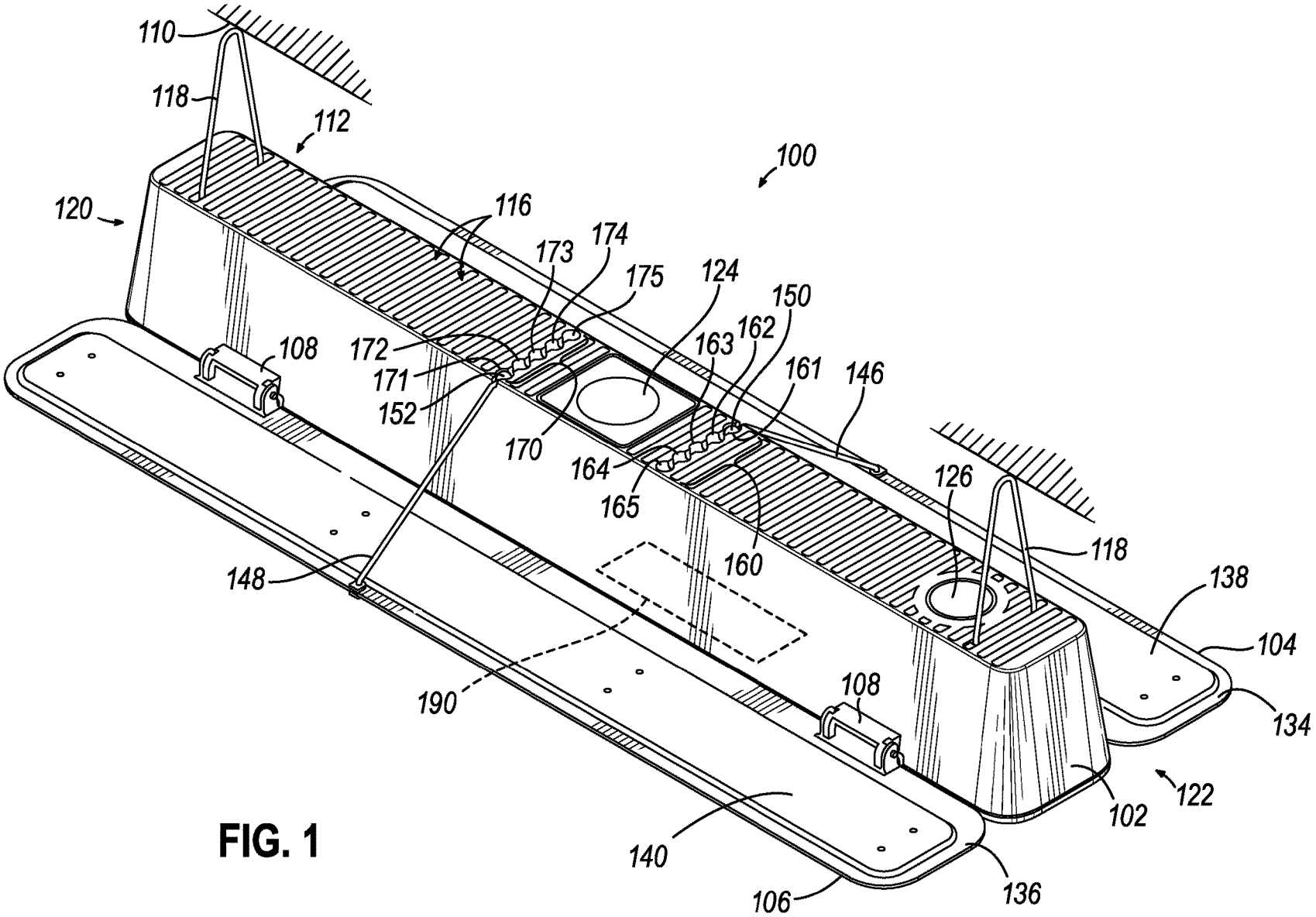
FIG. 1 is a top perspective view of a lighting fixture with both articulating lighting members in a first position.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, force, angles, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Figure 2:
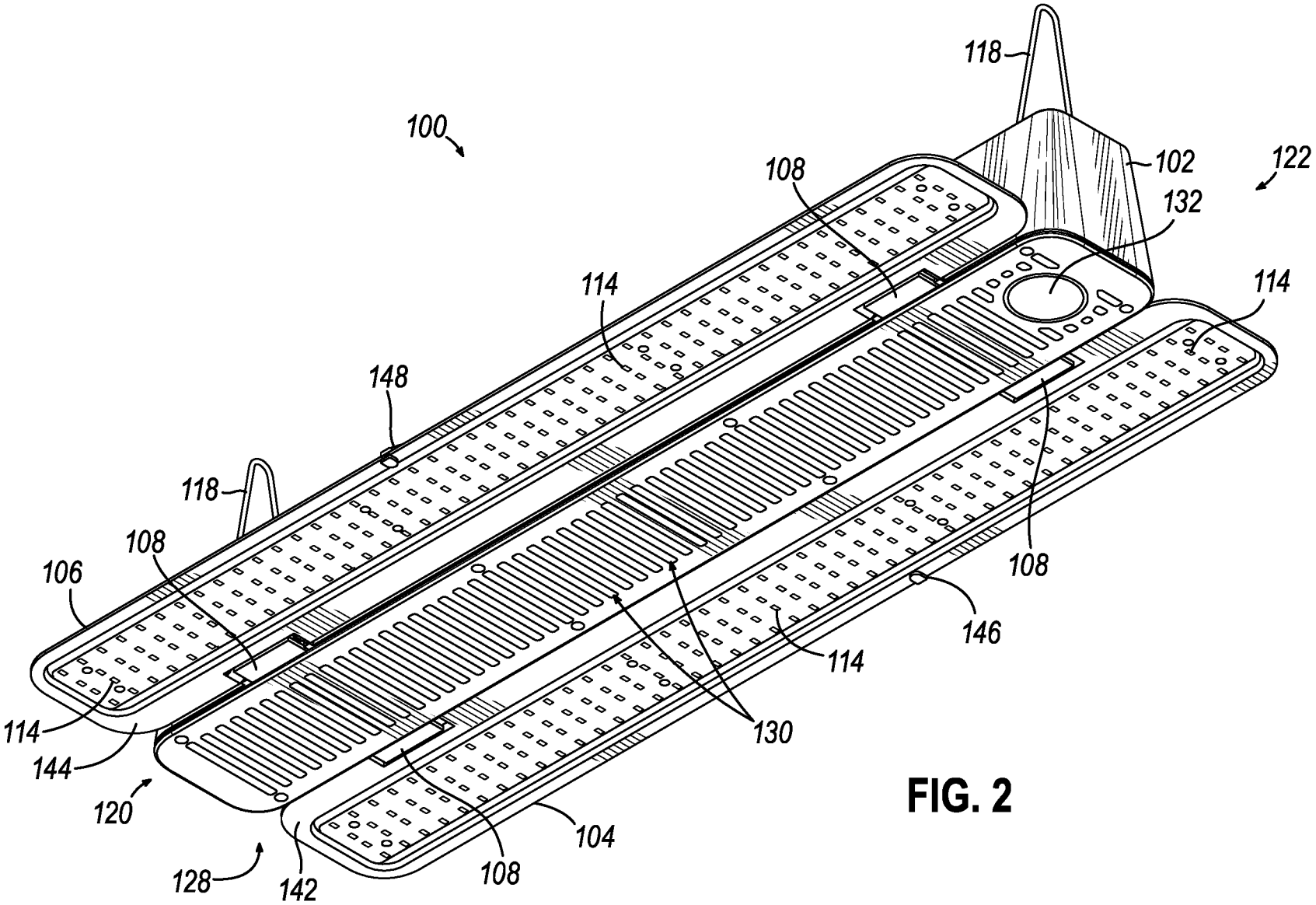
FIG. 2 is a bottom perspective view of the lighting fixture of FIG. 1.
Figure 3:
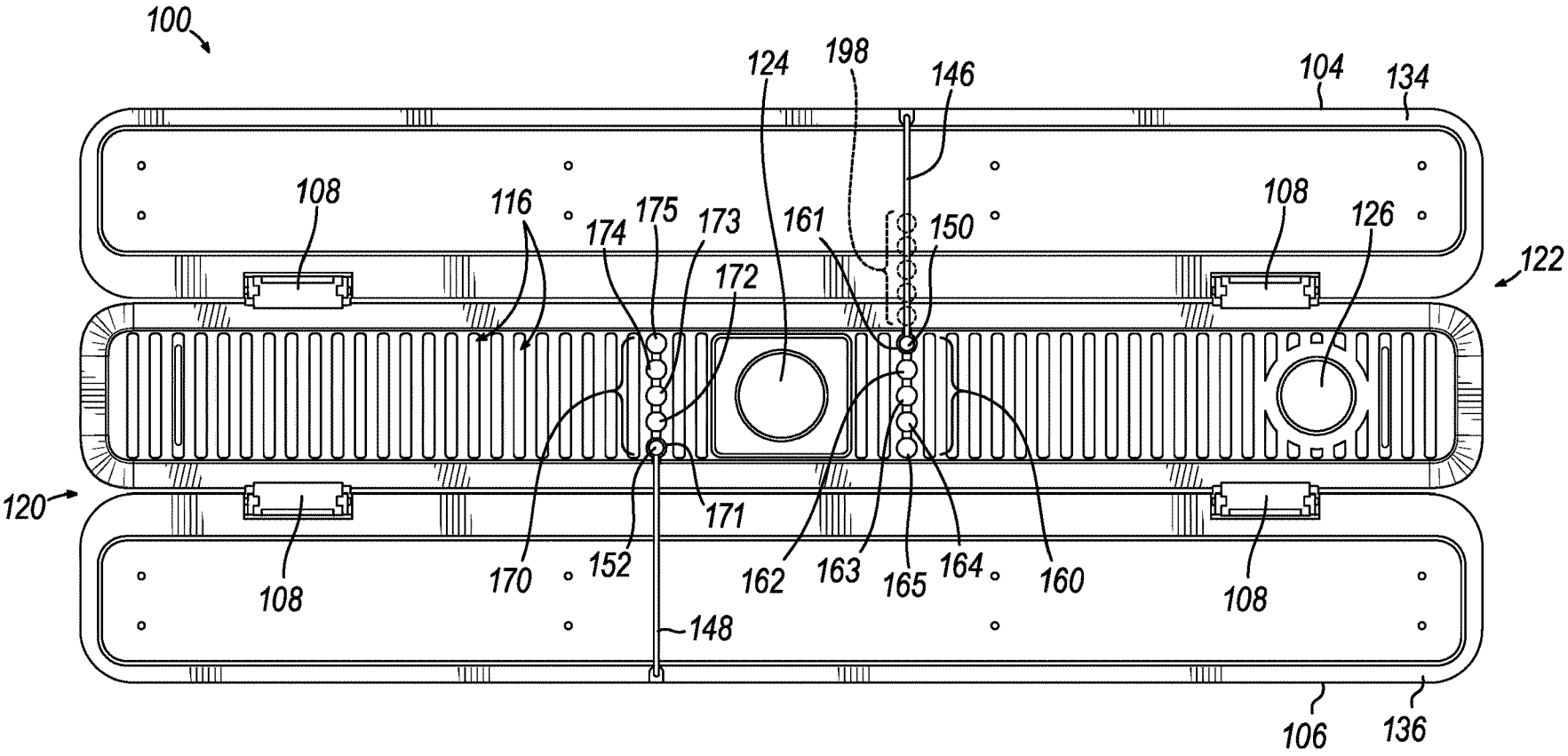
FIG. 3 is a top plan view of the lighting fixture of FIG. 1.

Depicted in FIGS. 1-3 is a lighting fixture 100 according to one embodiment of the present disclosure. Fixture 100 includes a central housing, or body 102, having opposing articulating panels 104, 106 coupled with the body 102. As will be described in greater detail below, panels 104, 106 are each coupled with the body via one or more moveable or hinged connections 108. Fixture 100 is configured to attach to a surface, such as a ceiling 110, at an upward-facing side 112 of the fixture 100 (i.e., relative to the ceiling), and distribute light in a downward direction away from the ceiling. The underside of articulating panels 104, 106 include one or more light emitters, such as LEDs 114, for selectively emitting light in a general direction away from articulating panels 104, 106 once activated. The LEDs 114 are powered by a power supply, such as LED driver (190), positioned inside the body 102. Accordingly, at least one of the moveable or hinged connections 108 may include an electrical connection, such as a wire or cable (not shown) disposed therein for electrically coupling the LEDs 114 of each panel 104, 106 with the power supply. While one particular embodiment of fixture 100 is illustrated herein, it should be understood that the body 102, and associated panels 104, 106, may take a different shape or size than is depicted, for example, by shortening, lengthening, or widening the body 102. In some versions, the body 102 is manufactured by extrusion methods and is configured to couple at the ends 120, 122 to additional fixtures 100 to form a continuous span of fixtures 100 having their bodies 102 axially aligned in a row.

In some alternative embodiments, panels 104, 106 may be "edge lit" flat panel LED luminaires. Edge-lit panels typically include a thin and lightweight outer housing having one or more edges of the flat panel which houses LED light sources, such as an elongated LED strip spanning across the edge. From the edge of the housing, portions of light emitted by the LEDs can transfer from the edges toward the middle of the panel by use of a medium (e.g., a lightguide) that evenly redirects and reflects the light toward the illumination surface of the light fixture. The light dispersion of edge lit panels can create an even light distribution that appears shadow-less at the illumination surface.

In some embodiments, the body 102 may include a plurality of air vents 116 for cooling the interior of the body 102 housing the power supply. As shown, air vents 116 are formed as parallel openings across the upward-facing side 112 of the body 102 and are therefore not visible from the underside of the fixture 100 by a person on the ground. In other embodiments, air vents 116 may be arranged in any other shapes, sizes, or may be positioned on any surface of the body 102 while still providing the cooling function described herein.

Further, in some embodiments, the body 102 may include one or more brackets 118 for attaching the fixture 100 to the ceiling surface. While brackets 118 are shown generally positioned at opposing ends 120, 122 of the fixture 100, brackets may be positioned anywhere along the upward-facing side 112 as required to hang the fixture 100 from the ceiling. In some embodiments, each of brackets 118 may be configured to insert into one air vent 116 during installation, or removed from the one air vent 116 and transferred to a different air vent 116 at the installer's choosing. In alternative embodiments, the body 102 may include a single pendant mount (194) (see FIG. 5) connecting the fixture 100 to the ceiling 110. The pendant mount (194) (see FIG. 5) may couple with the body 102 via a pendant knockout 124 formed into the body 102, or otherwise connectable to the body 102, at a generally centered position on the upward-facing side 112 of the body 102. Optionally, the body 102 may also include one or more knockouts 126 for running electrical wiring or inserting an accessory (192) (see FIG. 5), such as, an RF receiver, a photocell, or other commonly used lighting accessory components.

Similar to the upward-facing side 112 of the body 102, the downward-facing side 128 of the body 102 may also include one or more air vents 130 for cooling the interior of the body 102 and knockouts 132 for running electrical wiring or inserting an accessory, such as, an RF sensor (not shown), a photocell (not shown), or other common lighting accessory components.

In some versions, panels 104, 106 may include features for protecting the LEDs 114 from damage if the fixture 100 was to rest on a flat surface with the panels in the first position (i.e., extending away from the body 102 in parallel with the ceiling 110). As best shown in FIGS. 1 and 2, the upward-facing surfaces 134, 136 of panels 104, 106, respectively, each includes a raised portion 138, 140 that extends from upward-facing surfaces 134, 136 toward the ceiling 110. Accordingly, each opposing side of raised portions 138, 140, viewed from the downward-facing surfaces 142, 144 of panels 104, 106, respectively, form depressions relative to the downward-facing surfaces 142, 144. LEDs 114 may be positioned on downward-facing surfaces 142, 144 within the depressions formed by raised portions 138, 140 such that LEDs 114 do not come into contact with a surface if the fixture 100 is resting on a flat surface, for instance, prior to installation.

To minimize manufacturing costs, panels 104, 106 may be manufactured as identical parts (i.e., each panel is capable of being installed on either side of body 102), and raised portions 138, 140 may simply be provided by stamping the panels 104, 106 to form the raised portions 138, 140.

As illustrated, moveable connections 108 may in one embodiment be hinges for coupling the panels 104, 106 to the body 102 such that panels 104, 106 are able to articulate relative to the body 102. Accordingly, with continued reference to FIGS. 1-3, each panel 104, 106 includes a tether 146, 148 for coupling with the body 102 to affix the panel 104, 106 in a particular angular position relative to the body 102. Each tether 146, 148 is coupled at one end to its respective panel 104, 106, and is coupled at the opposite end to the upward-facing side 112 of the fixture 100. To couple tether 146 with the upward-facing side 112 of the fixture 100, the tether 146 may include a ball 150 shaped to fit within one of a series of anchor locations (i.e., alternative coupling configurations), or detents 160, aligned on the upward-facing side 112 of the body 102 to and hold securely into place. Similarly, tether 148 may include a ball 152 shaped to fit within one of a linear series of detents 170 aligned on the upward-facing side 112 of the body 102. Each tether 146, 148 may be a flexible string, cord, or rope. For example, in some embodiments, the tethers 146, 148 include nylon paracord, while in alternative embodiments the tethers 146, 148 may include steel cable or Kevlar string. In any case, the tethers 146, 148 may also optionally include an elastomer over mold. To independently change the angle of each panel 104, 106, therefore the angle of light distribution from the LEDs coupled with the panel 104, 106 relative to the ground while the fixture 100 is mounted to a ceiling 110, each ball 150, 152 may be transitioned between the series of detents 160, 170. Accordingly, each tether 146, 148 may functionally be shortened or lengthened as required by transitioning each ball 150, 152 to an adjacent detent 161-165, 171-175, and the weight of gravity holds each panel 104, 106 at its downward most pivot angle that is allowed by the tether 146, 148 and the selected detent 161-165, 171-175. The various positions of panels 104, 106 are depicted in FIGS. 4A-F. During installation, depending on the required installation parameters, the light distribution pattern may be initially selected by setting the initial positions of tethers 146, 148. Thereafter, to modify the angle of one or both panels 104, 106, a user may transition ball 150 between detents 161-165, or ball 152 between detents 171-175. Each series of detents 160, 170 may include each detent spaced apart such that transitioning from adjacent detents adjust the angle 180 formed between the X and Y axes (see, FIG. 4A) by approximately between 10 and 15 degrees. For example, by transitioning the ball 150 of the tether 146 from detent 161 to detent 162, the angle 180 of the panel 104 will transition from approximately 90-degrees to approximately 75-degrees with respect to the Y-axis. By placing the ball 150 into detent 165, the panel 104 will be held at approximately 40-degrees with respect to the Y-axis. Further, hinges 108 may be configured such that the panels 104, 106 may be held parallel to the Y-axis without utilizing tethers 146, 148. In alternative embodiments, each series of detents 160, 170 may include each of the first four detents (for example, detents 161-164 and detents 171-174) spaced apart such that transitioning between those detents adjusts the angle 180 formed between the X and Y axes (see, FIG. 4A) by approximately 10-degrees, and where the last detents 165, 175 are spaced further apart relative to the other detents such that the panels 104, 106 will be held approximately parallel to the Y-axis.

In alternative embodiments of fixture 100, tethers 146, 148 (shown in FIG. 3 only as tether 146), may each include a plurality of attachment balls 198, representing alternative attachment configurations, each shaped to fit within one single anchor location, or detent (e.g., detents 161, 171) (i.e., two total detents), on the upward-facing side 112 of the body 102 to and hold securely into place. To independently change the angle of each panel 104, 106, therefore the angle of light distribution from the LEDs coupled with the panel 104, 106 relative to the ground while the fixture 100 is mounted to a ceiling 110, each tether 146, 148 may be adjusted (e.g., shortened or lengthened) by attaching a different ball of attachment balls 198 of the respective tether 146, 148 to its anchor location. In other alternative embodiments, each tether 146, 148 may include a single ball (not shown) for attachment to a single detent (i.e., two total detents), each ball of which may slide along the tether and lock into place at any position along the tether.

Figure 4A:
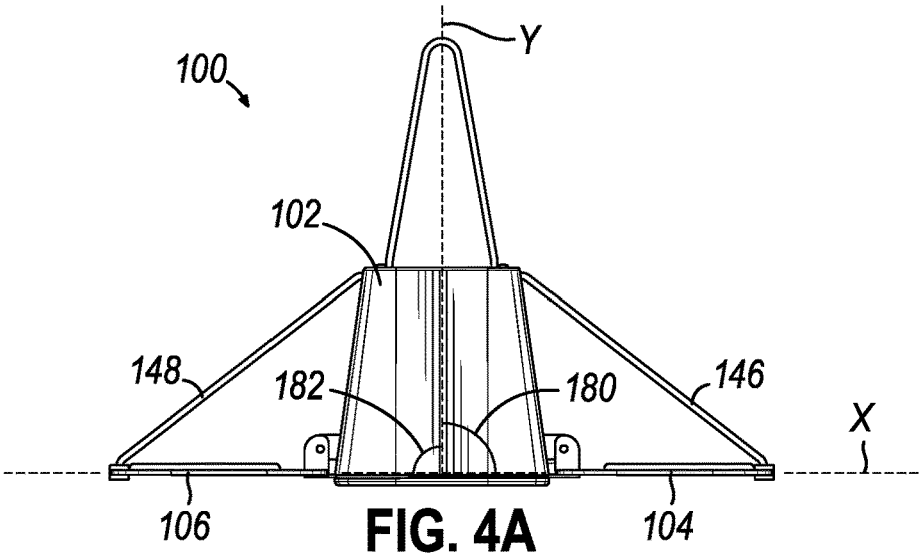
FIG. 4A is a right-side view of the lighting fixture of FIG. 1.
Figure 4B:
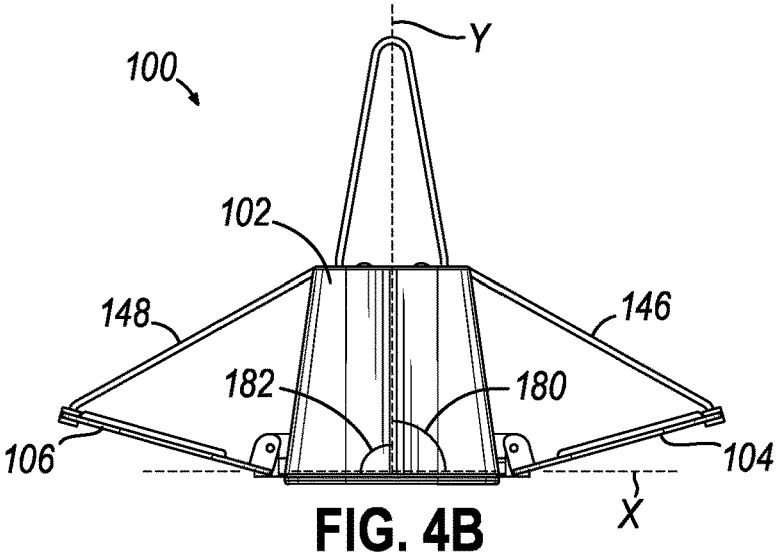
FIG. 4B is a right-side view of the lighting fixture of FIG. 1, shown with both articulating lighting members in a second position.
Figure 4C:
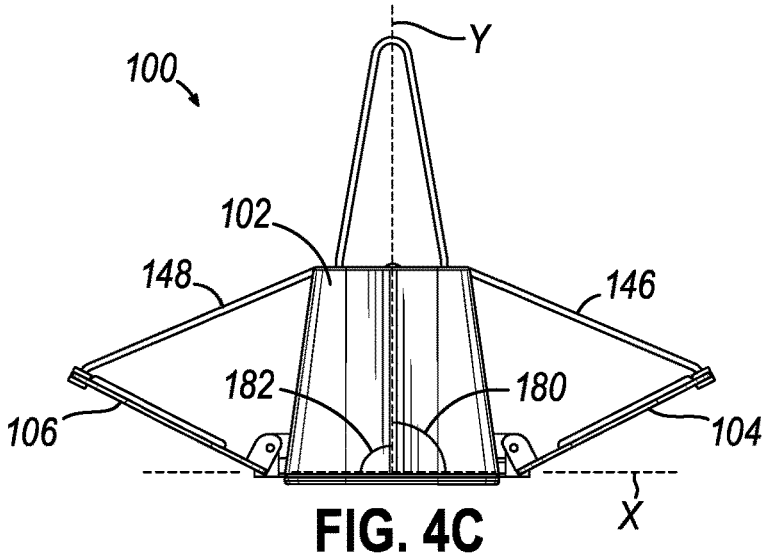
FIG. 4C is a right-side view of the lighting fixture of FIG. 1, shown with both articulating lighting members in a third position.
Figure 4D:
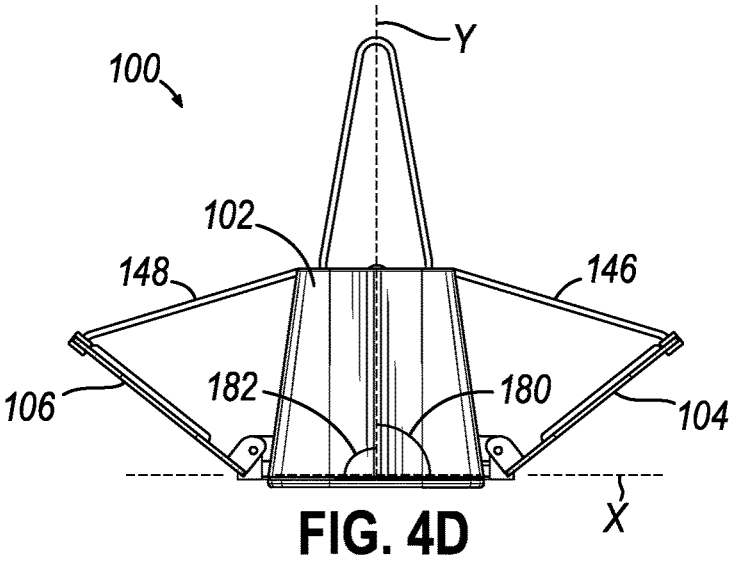
FIG. 4D is a right-side view of the lighting fixture of FIG. 1, shown with both articulating lighting members in a fourth position.
Figure 4E:
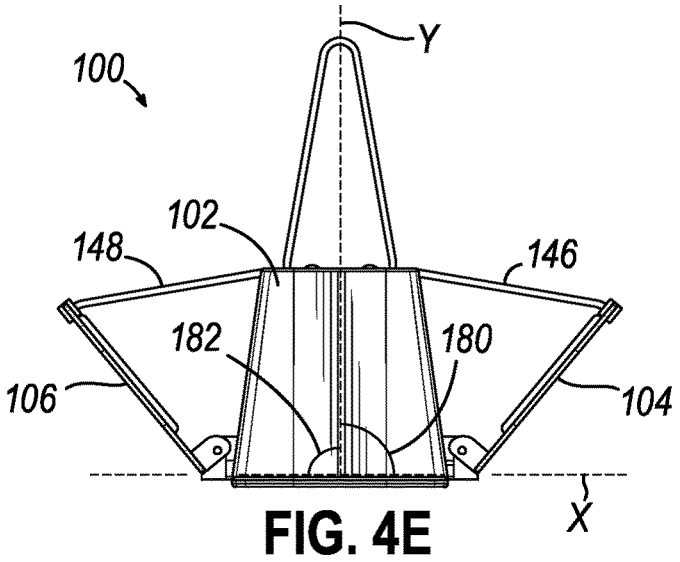
FIG. 4E is a right-side view of the lighting fixture of FIG. 1, shown with both articulating lighting members in a fifth position.
Figure 4F:
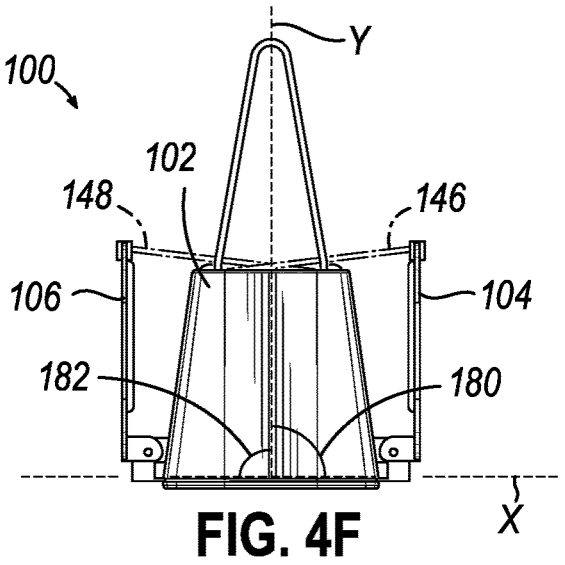
FIG. 4F is a right-side view of the lighting fixture of FIG. 1, shown with both articulating lighting members in a sixth position.

Depicted in FIGS. 4A-F are the various positions panels 104, 106 may be configured to as described above. As shown in FIG. 4A, each ball 150, 152 is positioned in the first detent 161, 171 and therefore each panel 104, 106 forms approximately 90-degree angles 180, 182 with respect to the Y-axis. As shown in FIG. 4B, each ball 150, 152 is positioned in the second detent 162, 172 and therefore each panel 104, 106 forms approximately 75-degree angles 180, 182 with respect to the Y-axis. As shown in FIG. 4C, each ball 150, 152 is positioned in the third detent 163, 173 and therefore each panel 104, 106 forms approximately 63-degree angles 180, 182 with respect to the Y-axis. As shown in FIG. 4D, each ball 150, 152 is positioned in the fourth detent 164, 174 and therefore each panel 104, 106 forms approximately 51-degree angles 180, 182 with respect to the Y-axis. As shown in FIG. 4E, each ball 150, 152 is positioned in the fifth detent 164, 174 and therefore each panel 104, 106 forms approximately 40-degree angles 180, 182 with respect to the Y-axis. As shown in FIG. 4F, each panel 104, 106 is approximately parallel with respect to the Y-axis. The configuration shown in FIG. 4F does not require either ball 150, 152 to be coupled with any detent 160, 170, as the hinges 108 are configured to securely hold the panels 104, 106 into place without the tethers 146, 148. Accordingly, tethers 146, 148 may be optionally included and placed into any detent 160, 170 as a fail-safe mechanism in case of any hinge 108 failing to secure the panels 104, 106 during operation, or for safe keeping of the tethers 146, 148 for later adjustment. Additionally, the configuration shown in FIG. 4F may be preferred for packaging and shipping the fixture 100 as it condenses the fixture 100 to a dimension which is the most compact as compared to any other configuration.

Figure 5:
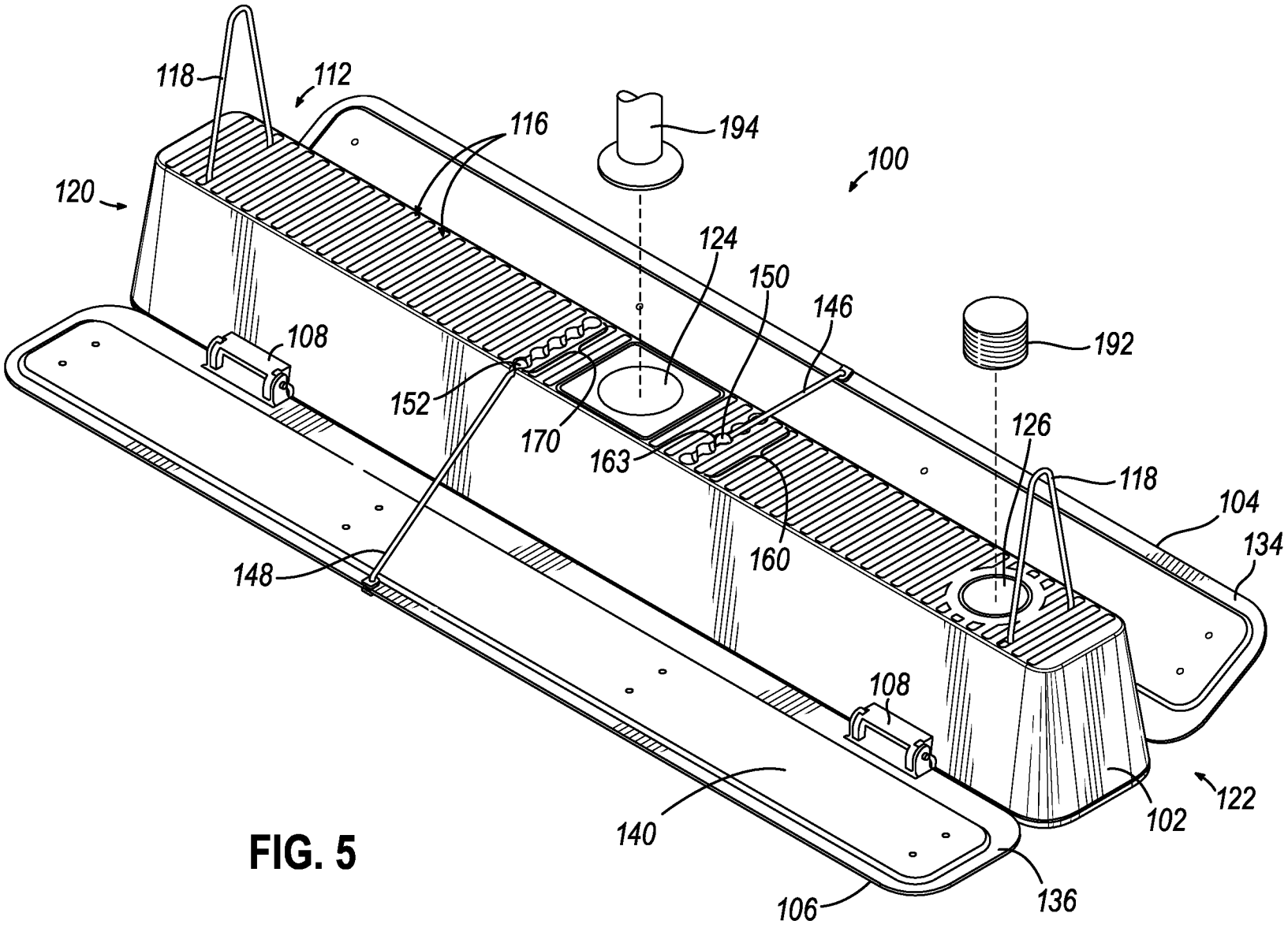
FIG. 5 is a top perspective view of the lighting fixture of FIG. 1, shown with a first articulating lighting member in the first position and a second articulating lighting member in the third position.
Figure 6:
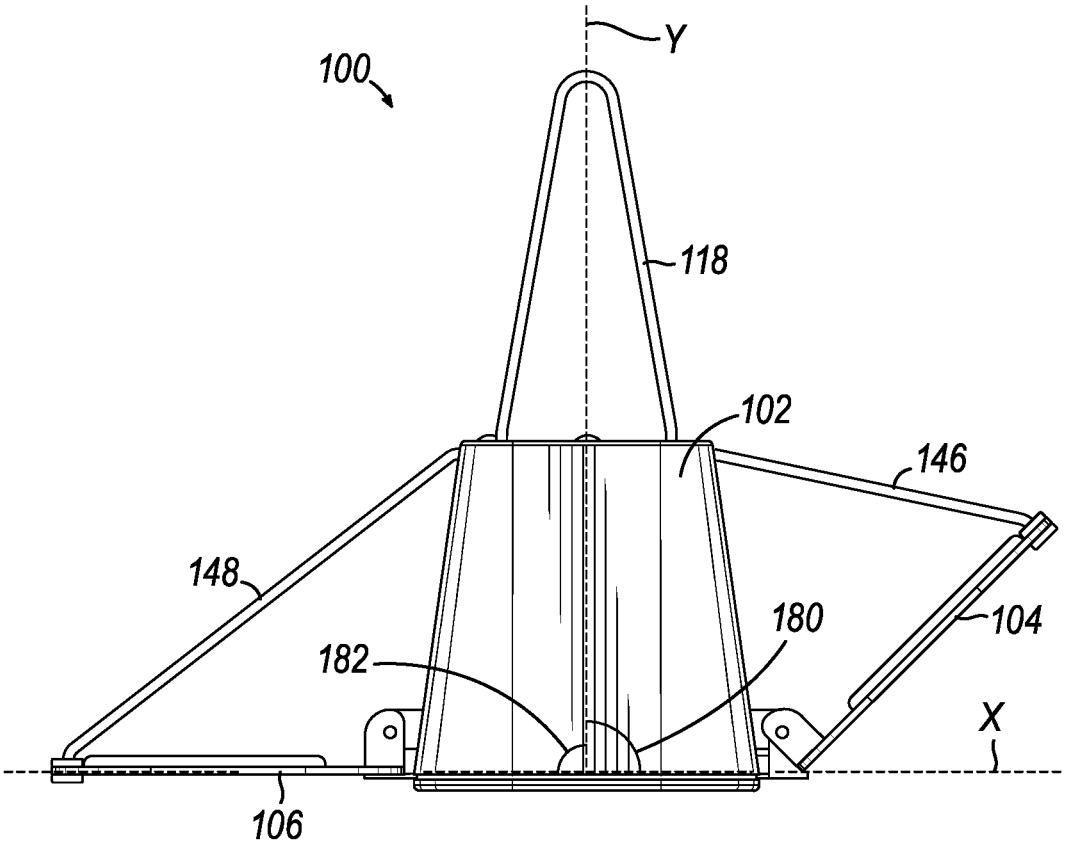
FIG. 6 is a right-side view of the lighting fixture of FIG. 5.

Depicted in FIGS. 5-6 is the fixture 100 shown with panels 104, 106 in non-matching positions. Particularly, ball 150 of tether 146 is positioned within detent 163, thereby positioning panel 104 at approximately a 45-degree angle 180 with respect to the Y-axis. Further, ball 152 of tether 148 is positioned within detent 171, thereby positioning panel 106 at approximately a 90-degree angle 182 with respect to the Y-axis. As described above, panels 104, 106 may freely be positioned in any of the available positions without regard for which position the other panel 104, 106 is in. This functionality allows the installer to configure the fixture 100 in any of 25 unique configurations as the dimensional circumstances or lighting preferences require.

Reference systems that may be used herein can refer generally to various directions (for example, upper, lower, forward and rearward), which are merely offered to assist the reader in understanding the various embodiments of the disclosure and are not to be interpreted as limiting. Other reference systems may be used to describe various embodiments, such as referring to the direction of projectile movement as it exits the firearm as being up, down, rearward or any other direction.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used or applied in combination with some or all of the features of other embodiments unless otherwise indicated. One or more exemplary embodiments have been shown and described, and all changes and modifications that come within the spirit of the disclosure are desired to be protected.

What is claimed is:

1. A light fixture, comprising:

a central housing defining first and second side surfaces and a bottom surface, wherein the bottom surface defines a first plane;

a first panel having a first edge and a second edge, the first edge pivotably coupled with the first side surface, the second edge being opposite to the first edge;

a first light source coupled with a first side of the first panel;

a first tether having a first end and a second end, wherein the first end is coupled with the first panel to pivotably suspend the first panel about the first edge, wherein the second end includes a first attachment member;

wherein central housing includes a first plurality of anchor positions;

wherein the first attachment member is configured to selectively couple with any one of the first plurality of anchor positions; and wherein the first panel is fixable between a first plurality of angles relative to the first plane as determined by the attachment member being coupled with a selected one of the first plurality of anchor positions.

2. The light fixture of claim 1, wherein the first panel is fixable to a first angle relative to the first plane when the first attachment member is coupled with the selected one of the first plurality of anchor positions, wherein the first panel is fixable to a second angle relative to the first plane when the first attachment member is coupled with a different anchor position of the first plurality of anchor positions, wherein the first and second angles are different.

3. The light fixture of claim 1, further comprising:

a second panel having a first edge and a second edge and defining a second plane, the first edge of the second panel pivotably coupled with the second side surface of the central housing;

a second light source coupled with a first side of the second panel;

a second tether having a first end and a second end, wherein the first end of the second tether is coupled with the second edge of the second panel, wherein the second end of the second tether includes a second attachment member;

wherein central housing includes a second plurality of anchor positions;

wherein the second attachment member is configured to selectively couple with any one of the second plurality of anchor positions; and wherein the second panel is fixable between a second plurality of angles relative to the second plane as determined by the attachment member being coupled with a selected one of the second plurality of anchor positions.

4. The light fixture of claim 3, wherein the first and second panels are independently fixable between the first and second plurality of angles, wherein the first panel is fixable to a first angle relative to the plane when the attachment member is coupled with the selected one anchor position of the first plurality of anchor positions, wherein the second panel is fixable to a second angle relative to the plane when the attachment member is coupled with the selected one anchor position of the second plurality of anchor positions, wherein the first and second angles are different.

5. The light fixture of claim 3, wherein the first and second panels are the same manufactured component.

6. The light fixture of claim 1, wherein the central housing defines a top surface located opposite to the bottom surface, wherein each of the first plurality of anchor positions is located on the top surface of the central housing.

7. The light fixture of claim 6, wherein the top surface and the bottom surface of the central housing define parallel planes.

8. The light fixture of claim 1, wherein the first plurality of anchor positions is arranged linearly.

9. The light fixture of claim 1, wherein the first panel includes a hinge for pivotably coupling the first panel with the first side surface of the central housing.

10. The light fixture of claim 1, wherein the central housing defines a top surface located opposite to the bottom surface, wherein the top surface of the central housing includes a mounting bracket configured to couple with a pendant mount for mounting the light fixture to a ceiling surface.

11. The light fixture of claim 1, wherein the central housing defines a top surface located opposite to the bottom surface, wherein the top surface of the central housing includes a knockout configured to couple with a lighting accessory.

12. The light fixture of claim 1, wherein the first light source includes LEDs, wherein the central housing includes an LED driver positioned therein that is electrically coupled with the LEDs and configured to receive power from a building's power source and supply power to the LEDs.

13. The light fixture of claim 12, further comprising a lighting accessory, wherein the lighting accessory includes an RF receiver, wherein the RF receiver is operable to communicate with the LED driver to adjust a lighting output of the LEDs.

14. The light fixture of claim 1, wherein one of the first plurality of angles is parallel with respect to the first plane.

15. The light fixture of claim 1, wherein one of the first plurality of angles is perpendicular with respect to the first plane.

16. A light fixture, comprising:

a central housing having a top surface and a bottom surface, wherein the top surface is configured to mount to a mounting location, the central housing defining first and second side surfaces separating the top surface and the bottom surface;

a first panel having a first edge and a second edge and defining a plane, the first edge pivotably coupled with the first side surface, the second edge being opposite to the first edge, wherein the first panel is configured to emit light;

a second panel having a first edge and a second edge on the plane, the first edge of the second panel pivotably coupled with the second side surface of the central housing, wherein the first panel is configured to emit light a first tether having a first end and a second end, wherein the first end is coupled with the second edge of the first panel, wherein the second end includes a first attachment member;

a second tether having a first end and a second end, wherein the first end is coupled with the second edge of the second panel, wherein the second end includes a second attachment member;

wherein central housing includes a plurality of anchor positions;

wherein the first and second attachment members are independently configured to selectively couple with any one of the plurality of anchor positions; and wherein the first and second panels are independently fixable between a plurality of angles relative to the plane as determined by the first and second attachment members each being coupled with different ones of the plurality of anchor positions.

17. The light fixture of claim 16, wherein the plurality of anchor positions is located on the top surface of the central housing.

18. The light fixture of claim 1, wherein the first panel includes a first hinge for pivotably coupling the first panel with the first side surface of the central housing, and wherein the second panel includes a second hinge for pivotably coupling the second panel with the second side surface of the central housing.

19. The light fixture of claim 16, wherein each of the first panel and second panel is independently adjustable via the first and second attachment members between a plurality of angles with respect to the plane, wherein the plurality of angles ranges from parallel to the plane to perpendicular to the plane.

20. A light fixture, comprising:

a central housing having a top surface and a bottom surface, wherein the top surface is configured to mount to a mounting location, the central housing defining first and second side surfaces separating the top surface and the bottom surface;

a panel configured to emit light, the panel having a first edge and a second edge and defining a plane, the first edge pivotably coupled with the first side surface, the second edge being opposite to the first edge;

a tether having a first end and a second end, wherein the first end is coupled with the second edge of the panel, wherein the second end includes a first securing feature;

wherein central housing includes a second securing feature, wherein the first and second securing features are configured to couple together;

wherein the panel is fixable between a plurality of angles relative to the plane as determined by the first and second securing features being coupled together at a selected one of a plurality of alternative coupling configurations defined by at least one of the first and second securing features, wherein the plurality of angles ranges from parallel to the plane to perpendicular to the plane.

* * * * *